US009517648B2

(12) United States Patent
Abe et al.

(10) Patent No.: US 9,517,648 B2
(45) Date of Patent: Dec. 13, 2016

(54) POROUS STAMP ASSEMBLY, AND MANUFACTURING METHOD AND APPARATUS OF THE SAME

(71) Applicant: Shachihata Inc., Naogoya-shi, Aichi (JP)

(72) Inventors: Eiji Abe, Anjo (JP); Masayoshi Uchida, Ichinomiya (JP)

(73) Assignee: SHACHIHATA INC., Nagoya-shi (JP)

( * ) Notice: Subject to any disclaimer, the term of this patent is extended or adjusted under 35 U.S.C. 154(b) by 0 days.

(21) Appl. No.: 13/779,399

(22) Filed: Feb. 27, 2013

(65) Prior Publication Data

US 2014/0020584 A1 Jan. 23, 2014

(30) Foreign Application Priority Data

Jul. 20, 2012 (JP) ..... 2012-162092
Jul. 30, 2012 (JP) ..... 2012-168052
Jan. 25, 2013 (JP) ..... 2013-011731

(51) Int. Cl.

| | |
|---|---|
| ***B41K 1/38*** | (2006.01) |
| ***B41K 1/50*** | (2006.01) |
| ***B41D 7/04*** | (2006.01) |
| ***B41K 1/00*** | (2006.01) |
| ***B41D 7/00*** | (2006.01) |

(52) U.S. Cl.

CPC . *B41K 1/50* (2013.01); *B41D 7/00* (2013.01); *B41D 7/04* (2013.01); *B41K 1/00* (2013.01); *B41K 1/38* (2013.01); *Y10T 156/17* (2015.01)

(58) Field of Classification Search

CPC ..... B41K 1/38; B41K 1/40; B41K 1/42; B41K 1/50; B41D 7/04; B41D 7/00

USPC ..... 101/327, 333

See application file for complete search history.

(56) References Cited

U.S. PATENT DOCUMENTS 5,559,545 A * 9/1996 Fuwa ..... 347/171
5,741,459 A 4/1998 Ando et al.
5,829,352 A * 11/1998 Taira et al. ..... 101/327

(Continued)

FOREIGN PATENT DOCUMENTS

EP 0 853 004 A1 7/1998
EP 1 805 032 A1 7/2007

(Continued)

OTHER PUBLICATIONS

Extended European Search Report dated Jan. 7, 2014 of European Patent Application No. 13156926.1 (8 pages).

*Primary Examiner* — Jill Culler
*Assistant Examiner* — Leo T Hinze
(74) *Attorney, Agent, or Firm* — Westerman, Hattori, Daniels & Adrian, LLP

(57) ABSTRACT

The present invention relates to a porous stamp assembly. The manufacturing method of the assembly comprises a first step of hermetically adhering a porous impression die member of thermoplastic resin to a front end face of a frame; a second step of fixing the die member embedded frame onto a mount that is to be in face-to-face relation with a thermal head attached to a seal carving device; a third step of putting the thermal head in contact with an impression surface of the porous impression die member, with a resin film interposed therebetween, and moving the thermal head and the porous impression die member relative to each other; and a fourth step of removing the die member embedded frame from the mount.

9 Claims, 17 Drawing Sheets

(56) References Cited

U.S. PATENT DOCUMENTS

| | | | | | |
|---|---|---|---|---|---|
| 5,845,573 | A | | 12/1998 | Miyata | |
| 5,878,668 | A | | 3/1999 | Ando et al. | |
| 5,996,493 | A | * | 12/1999 | Okumura et al. | 101/333 |
| 6,047,638 | A | * | 4/2000 | Taira | 101/135 |
| 6,112,662 | A | * | 9/2000 | Okumura et al. | 101/379 |
| 6,276,272 | B1 | * | 8/2001 | Takami et al. | 101/401.1 |
| 6,968,781 | B1 | * | 11/2005 | Petersen | 101/333 |
| 7,810,428 | B2 | | 10/2010 | Humal | |
| 2004/0003735 | A1 | * | 1/2004 | Humal | 101/401.1 |
| 2008/0053325 | A1 | | 3/2008 | Humal | |
| 2011/0204539 | A1 | * | 8/2011 | Matsushita et al. | 264/54 |

FOREIGN PATENT DOCUMENTS

| | | | |
|---|---|---|---|
| JP | 6-191133 | A | 7/1994 |
| JP | 9-314883 | A | 12/1997 |
| JP | 10-193763 | A | 7/1998 |
| JP | 3020416 | B2 | 3/2000 |
| JP | 2009-208294 | A | 9/2009 |
| WO | 2006042560 | A1 | 4/2006 |

* cited by examiner

POROUS STAMP ASSEMBLY, AND MANUFACTURING METHOD AND APPARATUS OF THE SAME

FIELD OF THE INVENTION

The present invention relates to a porous stamp assembly, and manufacturing method and apparatus of the same.

BACKGROUND ART

A porous stamp assembly is typically fabricated by providing a porous impression die member with a transfer area (ink permeable area) having a seal pattern and a non-transfer area (ink impermeable area). In order to discriminatively form the transfer area (ink permeable area) and the non-transfer area (ink impermeable area) from each other, employed is one well known method of using a thermal head. In such a method, the thermal head with a plurality of heating elements and a platen permit the porous impression die member to pass therebetween and simultaneously compress the porous impression die member (to 95 to 30% of its original thickness), and the heating elements emit heat selectively as in a given print dot pattern including a character(s) and/or a drawing, so that the non-transfer area showing ink impermeability is defined in the impression die member while the remaining portion on which thermal effect is not exerted due to the inactivated heating elements is left as the transfer area showing ink permeability (see Patent Document 1).

Some other manufacturing methods of the porous stamp assembly include the well-known one that, in response to the demand of customers who want to prepare for a variety of stamping die faces, the process has stages of creating an impression die and of impregnating it with ink at the end of its sequence.

In this method, an ink reservoir is housed in a stamp frame, and the stages of creating an impression die and of impregnating it with ink cannot be carried out till the stamp is assembled to have an intermediate product with the impression die member securely adhered to the stamp frame, which after all necessitates the subsequent stamp product finishing stages, namely, the stage of using the thermal head to create the impression die and the final stage of pouring ink into the ink reservoir to impregnate the impression die member with ink (see Patent Document 2).

Another well-known stamp assembly manufacturing method directed to raising efficiency in yielding such porous stamp assembly products includes a process where after a porous impression die member provided with a dry impression die and a tank member wet or soaked with ink are incorporated in a casing, ink from the tank member is penetrated into the porous impression die member (see Patent Document 3).

REFERENCE TO THE RELATED ART

Patent Document 1

Japanese Patent No. 3020416

Patent Document 2

Preliminary Publication of Unexamined Japanese Pat. Appl. No. H10-193763

Patent Document 3

Preliminary Publication of Unexamined Japanese Pat. Appl. No. H06-191133

Technical Problem

The prior art technologies disclosed in the above have disadvantages as discussed below:

The porous impression die member is likely to furrow after it is seal-carved into the impression die.

In the manufacturing method of the porous stamp assembly disclosed in Patent Document 1, for instance, since the thermal head and the platen permit the porous impression die member to pass therebetween and compress the porous impression die member (to 95 to 30% of its original thickness), the porous impression die member pulled back by the thermal head is deformed by a greater amount, which results in the impression die being furrowed.

Also, in the manufacturing method disclosed in Patent Document 2, since the ink reservoir is on the reverse side to a stamping face of the impression die member, the thermal head, coming in contact with the impression die member and sweeping all over its surface, is likely to fail to regularly receive repulsive force from the impression die member if the ink reservoir is insufficiently hard or adversely soft, and/or if its contact surface with the impression die member is excessively irregular, which results in the impression die is furrowed.

FIG. 17 depicts the porous impression die member being compressed and concurrently seal-carved into the impression die. Since it is the thermal head that compresses the porous impression die member and concurrently carves it into the impression die, the resultant impression die furrows, which resultantly fails to reproduce a desired character(s) and/or drawing in the impression die.

Another disadvantage is that the impression die is relatively deviated from the stamp handle.

Specifically, in the manufacturing method of the porous stamp assembly disclosed in Patent Document 1, the porous impression die member that has already had the impression die carved therein is adhered to the stamp handle, and hence, the relative adhesion position of the porous impression die member to the stamp handle is sometimes deviated from the predetermined position. This brings about a deviation of the impression die from the predetermined area relative to the stamp handle since the impression die is made in registration with a surface of reference of the porous impression die member, and thus, when a user grips the stamp handle and takes aim at an object in a normal manner, he or she will find the impressed seal on the object being out of position unlike he or she expects.

Additionally, in the manufacturing method of a self-inking stamp as disclosed in Patent Document 3, the porous impression die member already seal-carved to have the impression die therein is housed into the casing, and hence, the similar disadvantage arises that the impression die gets out of position relative to the casing.

Furthermore, there is an additional disadvantage that it takes time to impregnate the porous impression die member with ink.

Specifically, the disclosure of Patent Document 2 teaches that the ink reservoir serving as a well element is an essential component, and since the ink impregnation starts with pouring ink into the dry ink reservoir that is followed by impregnating the impression die member with ink, it takes much time to complete the ink impregnation.

SUMMARY OF THE INVENTION

The present invention is made to overcome the aforementioned disadvantages, and in a first aspect of the present invention, a manufacturing method of a porous stamp assembly comprises a first step of hermetically adhering a porous impression die member of thermoplastic resin to a front end face of a frame, for preparing a die member adhered frame, a second step of fixing the die member adhered frame onto a mount that is to be in face-to-face relation with a thermal head attached to a seal carving device, for bringing a recipient major surface of the mount in contact with a rear, ink impregnating face of the porous impression die member, a third step of putting the thermal head in contact with an impression surface of the porous impression die member, with a resin film interposed therebetween, and moving the thermal head and the porous impression die member relative to each other, for carving the impression surface of the porous impression die member into an impression die, and a fourth step of removing the die member adhered frame from the mount, and bringing and keeping the rear, ink impregnating face of the porous impression die member in contact with an ink retainer soaked with ink, for permitting a holder keeping the ink retainer therein to hold the die member adhered frame.

In a second aspect of the present invention according to the first aspect, the third step of putting the thermal head in contact with an impression surface of the porous impression die member includes using the thermal head to compress the porous impression die member with compressibility rate of 0 to 1% with the resin film interposed therebetween.

In a third aspect of the present invention according to the first aspect, the third step of putting the thermal head in contact with an impression surface of the porous impression die member includes using the thermal head to compress the porous impression die member with compressibility rate of 0% with the resin film interposed therebetween.

In a fourth aspect of the present invention according to the first aspect, the second step of fixing the die member adhered frame includes fitting and fixing a side wall of the die member adhered frame in space defined between a side surface(s) of the mount and a raised portion(s) by which the mount is partially or fully surrounded.

In a fifth aspect of the present invention according to the first aspect, the second step of fixing the die member adhered frame includes keeping a reverse end face of the die member adhered frame out of contact with the recipient major surface of the mount and a recipient major surface of a mount holder keeping the mount thereon.

In a sixth aspect of the present invention according to the first aspect, the second step of fixing the die member adhered frame includes providing a friction auxiliary element on the recipient major surface of the mount.

In a seventh aspect of the present invention, a porous stamp assembly is made, having its porous impression die member as thick as 0.1 mm to 1.2 mm, by the manufacturing method according to any of the first to sixth aspects of the invention.

In an eighth aspect of the present invention, a manufacturing apparatus of a porous stamp assembly comprises a first means hermetically adhering a porous impression die member of thermoplastic resin to a front end face of a frame, for preparing a die member adhered frame, a second means having a thermal head and fixing the die member adhered frame onto a mount that is to be in face-to-face relation with the thermal head, for bringing a recipient major surface of the mount in contact with a rear, ink impregnating face of the porous impression die member, a third means putting the thermal head in contact with an impression surface of the porous impression die member, with a resin film interposed therebetween, and moving the thermal head and the porous impression die member relative to each other, for carving the impression surface of the porous impression die member into an impression die, and a fourth means removing the die member adhered frame from the mount, and bringing and keeping the rear, ink impregnating face of the porous impression die member in contact with an ink retainer soaked with ink, for permitting a holder keeping the ink retainer therein to hold the die member adhered frame.

In a ninth aspect of the present invention according to the eighth aspect, regarding the third means, the thermal head in contact with the impression surface of the porous impression die member compresses the porous impression die member with compressibility rate of 0 to 1% with the resin film interposed therebetween.

In a tenth aspect of the present invention according to the eighth aspect, regarding the third means, the thermal head in contact with the impression surface of the porous impression die member compresses the porous impression die member with compressibility rate of 0% with the resin film interposed therebetween.

In an eleventh aspect of the present invention according to the eighth aspect, regarding the second means, the die member adhered frame has its side wall fitted and fixed in space defined between a side surface(s) of the mount and a raised portion(s) by which the mount is partially or fully surrounded.

In a twelfth aspect of the present invention according to the eighth aspect, regarding the second means, a reverse end face of the die member adhered frame keeps out of contact with the recipient major surface of the mount and a recipient major surface of a mount holder keeping the mount thereon.

In a thirteenth aspect of the present invention according to the eighth aspect, regarding the second means, a friction auxiliary element is provided on the recipient major surface of the mount.

Effect of the Invention

The porous stamp assembly, and the manufacturing method and apparatus of the same according to the present invention employ the mount provided in the seal carving device to serve as a platform member, and also employ the resin film interposed between the thermal head and the impression surface of the porous impression die member so that the thermal head in contact with the impression surface of the porous impression die member compresses the porous impression die member with compressibility rate of 0 to 1% with the resin film interposed between them, which resultantly enables the porous impression die member to avoid furrows in its impression surface after the impression die is carved thereon, thereby reproducing a given character(s) and/or drawing in the impression die as a stamping face with high precision.

Also, the frame that has its side wall fitted and fixed between two steady elements can avoid distortion of the side wall during the relative movement of the thermal head, and this further prevents the porous impression die member seal-carved into the impression die from having furrows in its impression surface.

In addition, by virtue of the inherent design in which the reverse end face of the die member adhered frame keeps out of contact with the recipient major surface of the mount and the recipient major surface of the mount holder keeping the mount thereon, even if some dimension error in molding makes the side wall of the frame be slightly excessive in length, it is avoidable that the recipient major surface of the mount is detached from the rear, ink impregnating face of the porous impression die member, letting the latter float up, and this is advantageous in that the porous impression die member is furrowless and capable of reproducing the given character(s) and/or drawing with high precision and that restrictions on molding are eased since extreme dimensional accuracy is not required.

Moreover, the friction auxiliary element provided on the recipient major surface of the mount prevents the porous impression die member seal-carved into the impression die from having furrows in its impression surface as a result of the relative movement of the thermal head that is likely to hitch the porous impression die member having its part fused, and thus, the given character(s) and/or drawing can be reproduced with high precision. This effect becomes more significant as an area of the impression die is larger.

Additionally, since after being adhered to the frame, the impression die member is carved into the impression die, the seal carving for the stamping face carried out within the frame serving as a range of reference would not cause a trouble of deviation of the impression die from the predetermined position in the frame. Also, positioning the frame relative to its holder serving as a reference would not bring about a trouble of deviation of the impression die from the predetermined position in the holder.

Also, since the porous impression die member, after being carved into the impression die, can be impregnated with ink directly from its reverse side by putting the ink retainer soaked with ink in contact with the reverse side of the porous impression die member and holding it thereon, the ink impregnation is quick and facilitated. The porous impression die member having thickness of 0.1 mm to 1.2 mm is also advantageous in considerably shortening time required to impregnate it with ink.

BEST MODE OF THE INVENTION

A porous stamp assembly, and manufacturing method and apparatus of the same according to the present invention will now be described in the context of a first one of embodiments with reference to the accompanying drawings.

This embodiment of the porous stamp assembly has, as shown in FIGS. 1 to 6, a porous impression die member 1 of thermoplastic resin, a frame 2 to which the porous impression die member 1 is hermetically adhered, and a holder 4 keeping an ink retainer 3 soaked with ink therein.

Herein, the terms expressing orientations of the porous stamp assembly include 'front,' 'upper,' or 'distal' for a direction in which any component faces toward the impression die as a stamping face, and 'reverse', 'lower', or 'proximal' for the opposite direction.

Figure 1:
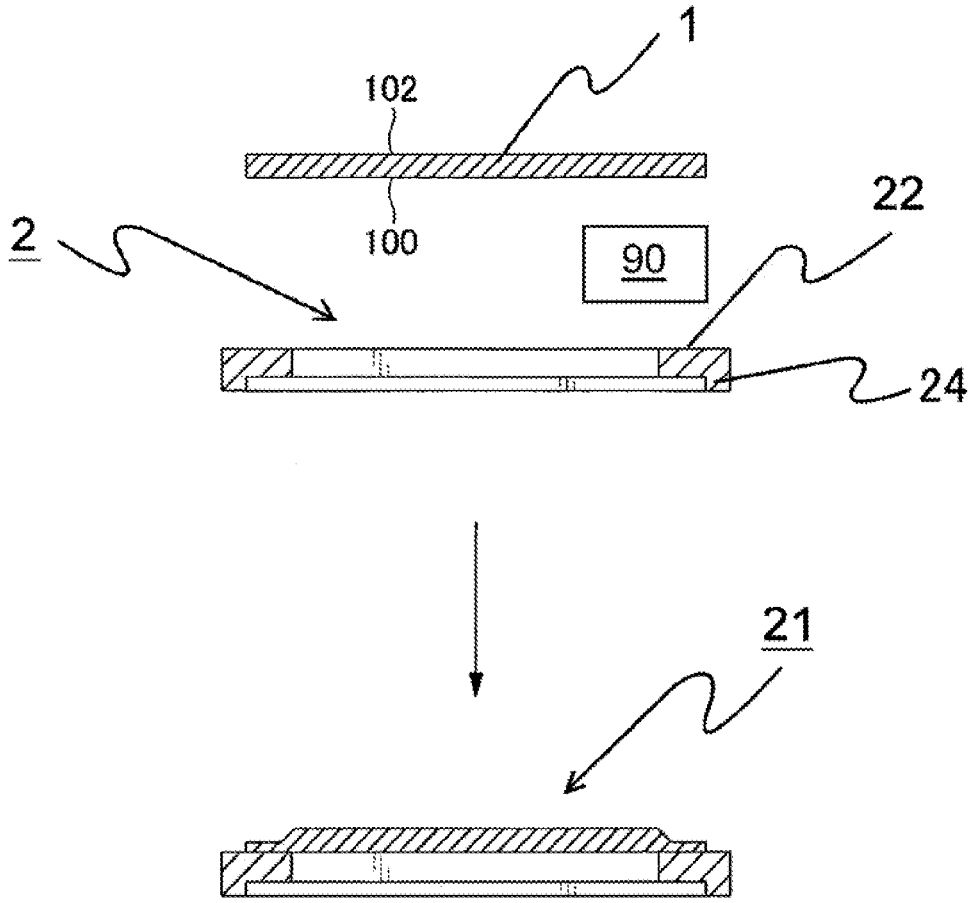
FIG. 1 is a diagram showing a first step and a first means in a first embodiment of the present invention.

Referring to FIG. 1, the porous impression die member 1 of thermoplastic resin may be of any porous material that can have its surface fused by pressing a thermal head against it, including porous materials made of substances such as thermoplastic resins and thermoplastic elastomers; more specifically, those made of substances such as polyolefin type synthetic resins, other types of synthetic resins such as polyamide, polyurethane, polyester, polyvinyl, polyacetal, and the like, and thermoplastic elastomers of styrene type, vinyl chloride type, olefin type, polyester type, polyamide type, and urethane type among which commercially available products are the ones made of substances such as polyethylene, polypropylene, nylon, polyurethane, polyester, polyvinyl chloride, polyvinyl chloride acetate copolymer, polyvinyl alcohol, polyethylene terephthalate, polyacetal resin, polycarbonate, and the like.

In order to produce a porous medium from any of the aforementioned substances alone or in combination, a mechanical system equipped with a heating/pressing kneader, heating rollers, and the like is used to knead a mixture of soluble substances like starch, salt, sodium nitrate, calcium carbonate, and so forth with the thermoplastic resin or the thermoplastic elastomer, and extrude the mixture in sheet, which is succeedingly cooled and then exposed to the eluent of water or dilute acid solution to make it porous. The porous medium thus fabricated has a fusing point identical with that of the raw material resin, and is capable of vary its fusing point as desired by means of blending additives/fillers such as pigment, dye, inorganic substance, and the like. The impression die member in this embodiment that is to be carved into an impression die is suitably 70 to 120° C. in fusing point.

Porosity and pore size of the porous impression die member 1 are determined, depending upon particle size and content of the soluble substances in the mixture. The porous impression die member 1 in this embodiment that is to be carved into the impression die by a seal carving device is a single- or dual-stratum porous medium having porosity of 50 to 80%, and pore size of 1 to 20 μm in an upper layer of the single- or dual-stratum structure and that of 50 to 100 μm in a lower layer. The lower layer may be replaced with an ink retainer of felt or some other material.

The porous impression die member may be in the form of a thin membrane material such as a sheet ("sheet-form") or a film ("film-form").

Figure 3:
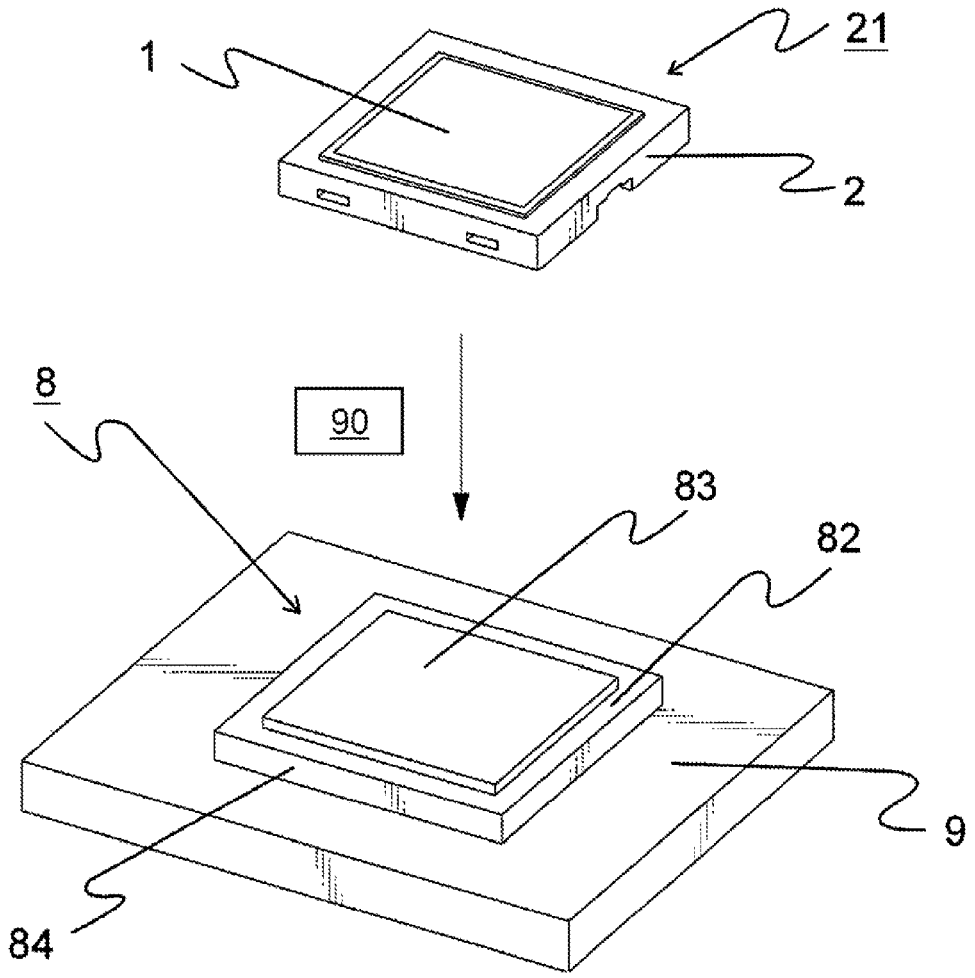
FIG. 3 is a perspective view illustrating the second step and the second means in the first embodiment of the present invention.

As can be seen in FIGS. 1 and 3, the frame 2 to which the porous impression die member 1 is hermetically adhered is a rectangular frame, having its vertical cross-section roughly L-shaped. Such a rough L-shape in cross section has a longer axis of which horizontally coplanar dimension is a front end face 22, and a side wall 24 extends vertically downward from an outer perimeter of the front end face 22. The porous impression die member 1 has its outer portion hermetically adhered to the front end face 22 continuously all the way round. Hermetical adhesion of the porous impression die member 1 to the frame 2 is carried out by means of thermal fusing, bonding agent, and the like. The term 'adhesion' means that one object is securely united with another, and in this embodiment, the porous impression die member 1 is securely united with the frame 2. More specific manners of such hermetical adhesion will be detailed in the later discussion of a first step and a first means of this embodiment.

Figure 5:
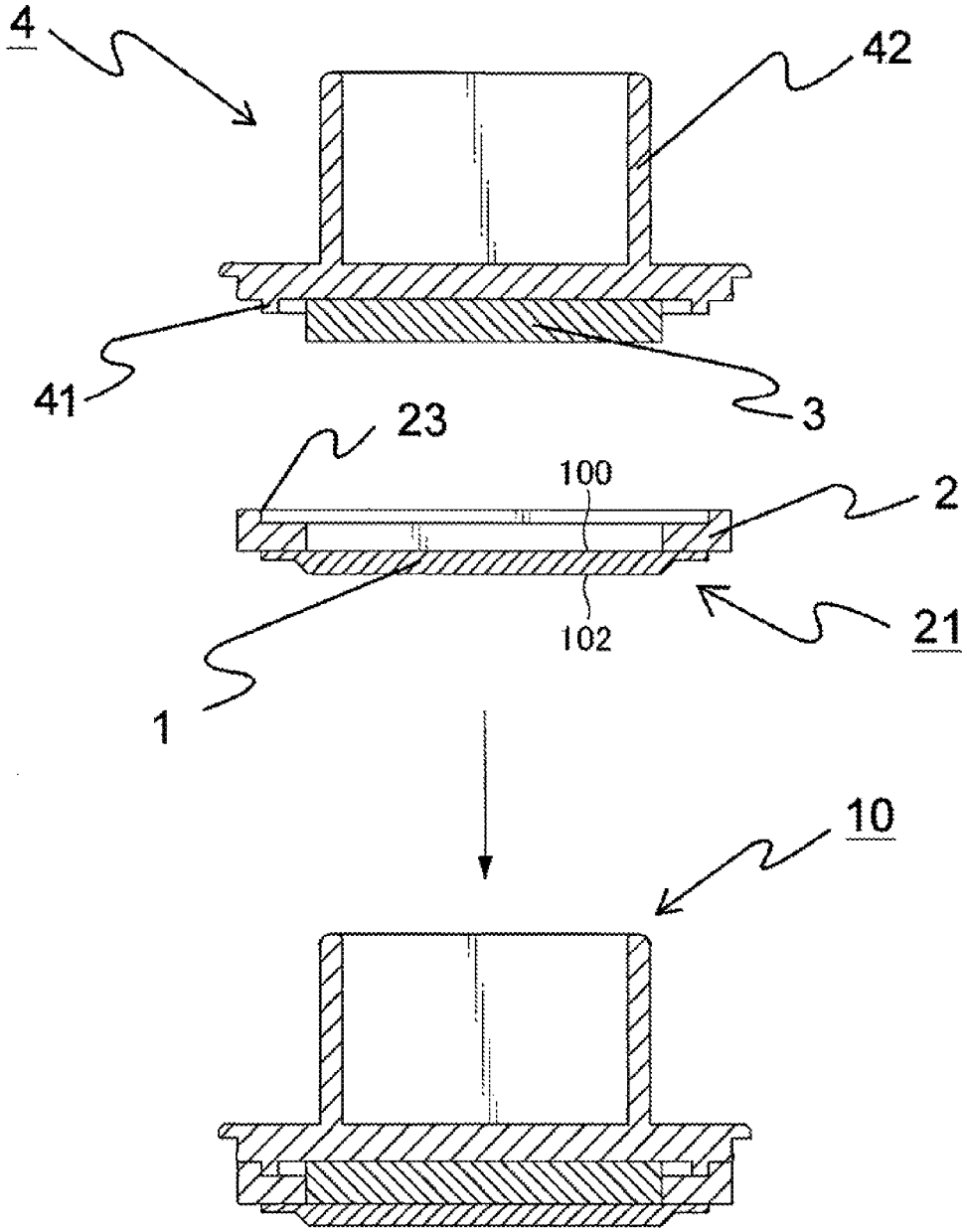
FIG. 5 is a perspective view illustrating a fourth step and a fourth means in the first embodiment of the present invention.

As shown in FIG. 5, the frame 2 is held by the holder 4 described later. The frame 2 and the holder 4 are joined together by intermesh fitting, over-ride fitting, and/or the like. One of mating components such as a female member 23 provided in an inner surface of the side wall of the frame 2 mates with the other mating component such as a male member 41 provided in an outer surface of a side wall of the holder 4.

The frame 2 does not necessarily have to be rectangular in shape but may be annular. In such a case, both the elements may be joined together by means of screw-thread fitting other the intermesh fitting and the over-ride fitting.

Although not shown in the accompanying drawings, a notch-like female member is provided in the side wall of the frame 2 while a mating male member is provided in the side wall of the holder 4, so as to ensure a relative orientation of the frame 2 with the holder 4.

The frame 2 may be made of any of thermoplastic resins including polyethylene, polypropylene, polybutylene, polyurethane, polysthyrene, polyvinyl chloride, polyester, polycarbonate, thermoplastic elastomers of polyethylene type, polypropylene type, polybutylene type, polyurethane type, polystyrene type, polydiene type, and polychloride type, ethylene-vinyl acetate copolymer, and the like. Especially, the frame 2 is preferably made of the same or similar type of material as the porous impression die member from the viewpoint of holdability, and if polyolefin type thermoplastic resin is used to fabricate the porous impression die member, the same polyolefin type thermoplastic resin is preferably used to fabricate the frame 2.

As shown in FIG. 5, a material of the ink retainer 3 soaked with ink may be, for example, a natural fiber such as a wool fiber, or an ink impregnatable (ink retainable) felt of a synthetic fiber (polyester, polyamide, acryl, or the like) or a natural fiber.

The ink retainer 3 may be any type of ink supply that is capable of impregnating the porous impression die member 1 with ink, and no restrictions are put on its hardness and shape as requirements for having the impression die carved therein.

The ink may be any type available as a stamp ink as desired, including pigment, dye, oil-color ink, water-color ink, and the like, and soaking the ink retainer 3 with ink may also be in any way well known in the art, for example, by means of vacuum impregnation.

As can be seen in FIG. 5, the holder 4 keeping the ink retainer 3 therein is provided with the mating component such as the male member 41 to mate with the frame 2, and a gripper 42. The ink retainer 3 is kept within the holder 4 by means of bonding and/or intermesh fitting.

By the holder 4, the frame 2 is held. The holder 4 and the frame 2 are united together by means of intermesh fitting, over-ride fitting, and/or the like. When one of the mating components such as the female member 23 is provided in the inner surface of the side wall of the frame 2, the other component to mate with, such as the male member 41, is provided in the outer surface of the side wall of the holder 4.

Although not shown in the accompanying drawing, the holder may have the male member to mate with the female member provided in the side wall of the frame 2.

The holder 4 may be made of any of thermoplastic resins including polyethylene, polypropylene, polybutylene, polyurethane, polysthyrene, polyvinyl chloride, polyester, polycarbonate, thermoplastic elastomers of polyethylene type, polypropylene type, polybutylene type, polyurethane type, polystyrene type, polydiene type, and polychloride type, ethylene-vinyl acetate copolymer, and the like.

Next, referring to FIG. 1, the first step and the first means in and by which the porous impression die member 1 is hermetically adhered to the front end face 22 of the frame 2 to prepare a die member adhered frame 21 will now be described in detail.

The porous impression die member 1 has its outer portion hermetically adhered to the front end face 22 continuously all the way round by means of thermal fusion. Specifically, a thermal sealing jig 90 (shown diagrammatically in FIGS. 1, 2, and 3) broad enough to thermally fuse a continuous area all the way round in the porous impression die member 1 and the front end face 22, respectively, concurrent with each other, and after heated up to a temperature higher than fusing points of both the porous impression die member 1 and the frame 2, the thermal sealing jig is pressed to them for several seconds. Then, the porous impression die member 1 and the frame 2 are fused and hermetically adhered to each other, having their respective parts polymerized or merged into each other. In this way, however often stamping may be repeated, the porous impression die member 1 has its outer portion still secured to the frame 2 without falling apart, and thus, the finished die member adhered frame 21 attains an enhanced hermetic seal.

A target position in which the porous impression die member 1 has its outer portion hermetically adhered to the frame 2 is not limited to the front end surface 22, and alternatively, the former may be adhered to the latter in an outer surface of the side wall. In such a case, the porous impression die member 1 wraps the front end face 22, and the hermetic seal is provided along the outer surface of the side wall of the frame 2.

During providing the hermetic seal, a protection film may be put on the porous impression die member 1 to protect its surface and ensure releasability from the thermal sealing jig. The protection film may be a plastic film durable to high temperature, such as a film of polyethylene terephthalate, polyethylene naphthalate, polyamide, polytetrafluoroethylene, fluoride, silicone, or the like.

Figure 2:
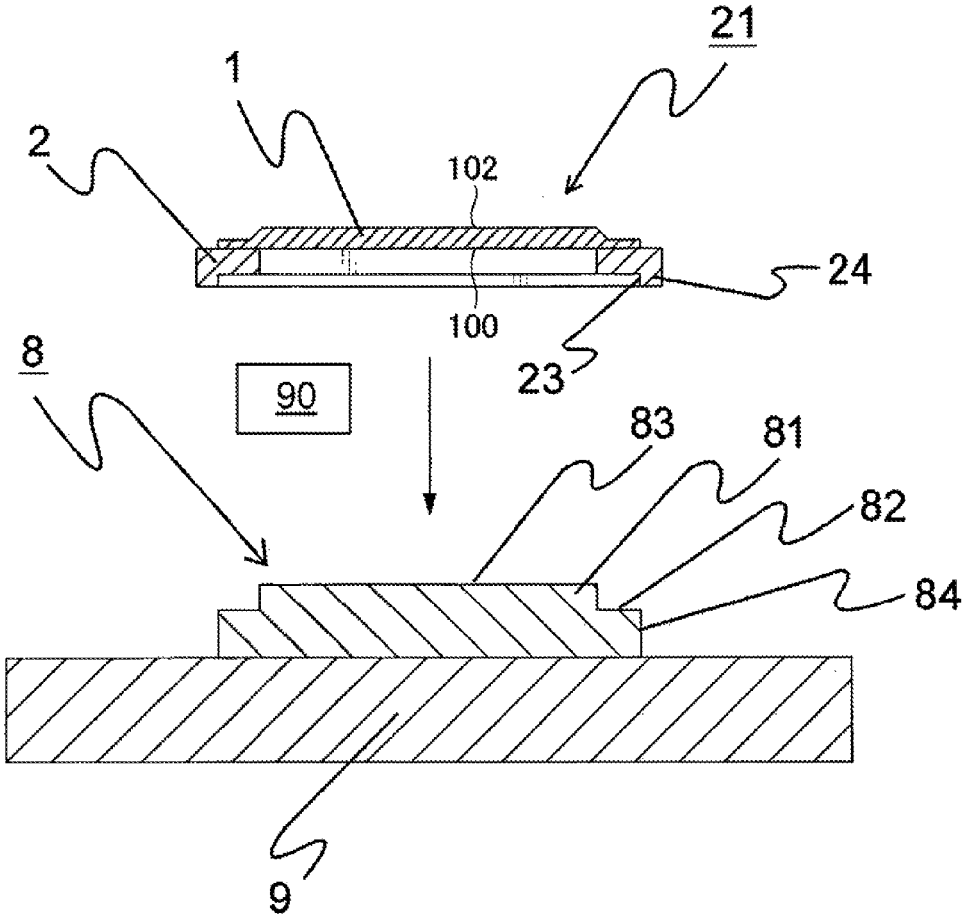
FIG. 2 is a diagram showing a second step and a second means in the first embodiment of the present invention.
Figure 4:
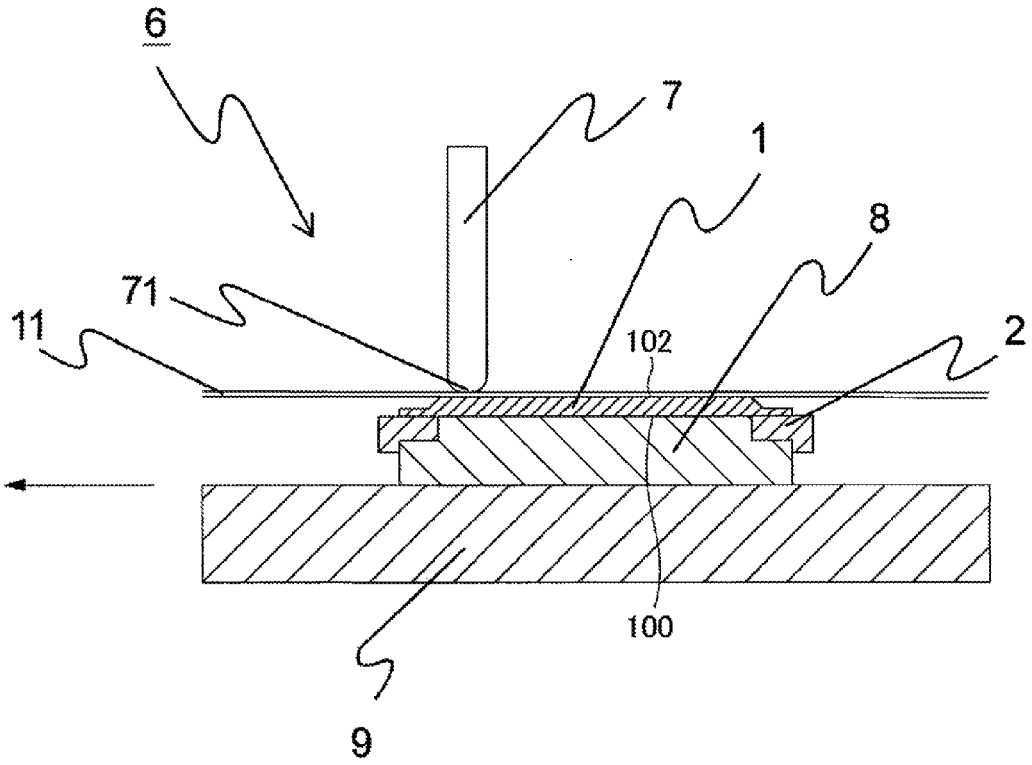
FIG. 4 is a diagram showing a third step and a third means in the first embodiment of the present invention.

Now, described in detail referring to FIGS. 2, 3, and 4 will be a second step and a second means in and by which the die member adhered frame 21 is fitted and fixed onto the mount 8 that is to be in face-to-face relation with a thermal head 7 (shown in FIG. 4) attached to a seal carving device 6, and then, a recipient major surface 83 of the mount 8 is brought in contact with a rear, ink impregnating face 100 of the impression die member 1.

First, the seal carving device 6 will now be described.

As shown in FIG. 4, the seal carving device 6 has at least the thermal head 7 provided with a plurality of heating elements arranged in a line, the mount 8 the die member adhered frame 21 is to be mounted on, a mount holder 9 keeping the mount 8 thereon, and a resin film 11 that is to be interposed between the thermal head 7 and the porous impression die member 1 when the latter is fitted on the mount 8.

Although not shown, additional components are provided in the seal carving device 6, including a thermal head holder keeping the thermal head 7, a load applier for applying load to or pressing the thermal head 7, a drive gear moving the mount holder 9 along with the mount 8 relative to the thermal head 7, and a stepping motor driving the drive gear.

The resin film 11 is employed to shoot a trouble that fused resin from the porous impression die member 1 sticks to the thermal head 7, or any other trouble caused due to an increase in coefficient of friction and the resultant failure in seal-carving a stamping surface. As to the resin film 11, poly film materials primarily used in the viewpoint of heat resistance and smoothness include cellophane, acetate, polyvinyl chloride, polyethylene, polypropylene, polyester, polyethylene terephthalate, polytetrafluoroethylene, polyimide, polyamide, and the like.

A driving means for the seal carving device 6 in this embodiment may be any means by which the mount 8 loaded with the porous impression die member 1 is moved relative to the thermal head 7 fixed in position, any means by which the thermal head 7 is moved relative to the mount 8 loaded with the porous impression die member 1 and fixed in position, or the like.

The seal carving device 6 is connected to a computer (not shown), and setting for velocity of seal-carving and controlling operations to start the seal carving are carried out by referring to and touching a screen of the computer. A pattern of a desired character(s) and drawing is customized based on a data source of computer graphic images. Heating element thermo control data is also customized based on a data source of monochromatic images created by using a computerized typesetting software, and the seal carving is conducted based on the heating element thermo control data.

As will be recognized in FIGS. 2 and 3, the mount 8 is kept on top of the mount holder 9. The mount 8 has a recipient mount portion 81 almost prismatic in shape and a flange 82 extended from a perimeter of the recipient mount portion 81. A recipient major surface 83 of the recipient mount portion 81 is planar without up and down and/or bump and dent. It may be of any of materials such as resin and metal so far as hard enough to protect the mount 8 from being deformed when the porous impression die member 1 comes in contact and/or when the thermal head 7 is pressed against. The recipient major surface 83 of the mount 8 is in face-to-face relation with the thermal head 7 in operation, and whenever it is so, a distal end face 71 of the thermal head 7 is in parallel with the recipient major surface 83 of the mount 8. An area in which the impression die is made during carving the surface of the porous impression die member is totally determined by the mount 8 serving as a surface of reference.

The second step and the second means will be detailed further.

The second step is a step in which the die member adhered frame 21 prepared in the previous or first step is put on the mount 8. As illustrated in FIGS. 2 and 3, when the die member adhered frame 21 is put on the mount 8, the reverse or rear, ink impregnating face 100 of the porous impression die member 1 is brought in contact with it. Concurrently, the inner surface of the side wall of the frame 2 is fitted and fixed onto a side surface 84 of the flange 82, and the reverse side to the front end surface 22 of the frame 2 is put in contact with the flange 22, so that the rear, ink impregnating face 100 of the porous impression die member 1 coming in contact with the recipient major surface 83 of the mount 8 is retained thereon. Vertically adjusting a point of contact of the reverse side to the front end surface 22 of the frame 2 with the flange 82 permits tightness of contact to be appropriately adjusted between the recipient major surface 83 of the mount 8 and the rear, ink impregnating face 100 of the porous impression die member 1. Dimensional adjustment in advance should be scrupulous so that the rear, ink impregnating face 100 of the porous impression die member 1 is pushed up on the recipient major surface 83 while the die member adhered frame 21 cross-straddles on the mount 8, thereby being able to avoid a trouble that the rear, ink impregnating face 100 of the porous impression die member 1 keeps out of contact with the recipient major surface 83 of the mount 8, letting the latter float up.

Although not shown in the accompanying drawings, a notch-like female member is provided in the inner surface of the side wall of the frame 2 while a mating male member is provided in the side surface of the flange 82, so as to ensure a relative orientation of the die member adhered frame 21 with the mount 8.

The mating members used to ensure the relative orientation of the die member adhered frame 21 with the mount 8 may also be used as the mating members that ensure the orientation of the die member adhered frame 21 with the holder 4.

Now discussed below referring to FIG. 4 will be a third step and a third means in and by which the thermal head 7, being brought in contact with the impression surface 102 of the porous impression die member 1 with the resin film interposed therebetween, is moved relative to the porous impression die member 1 to carve an impression die in the impression surface of the porous impression die member 1.

The third step and the third means are a step and a means dependent on the second step and the second means, respectively, in and by which the thermal head 7 is used to carve the impression surface 102 of the porous impression die member 1 fixed on the recipient major surface 83 of the mount 8 to make the impression die/stamping face.

The thermal head 7 is pressed against the resin film 11 and thus against the underlying impression surface 102 of the porous impression die member 1 residing on the recipient major surface 83 of the mount 8 and is simultaneously moved relative to the impression die member 1 so as to carve it. A means in this embodiment for driving the seal carving device 6 forces the mount 8 along with the porous impression die member 1 thereon to move (to the left in the drawing) while the thermal head 7 is fixed. Keeping the thermal head 7 always in parallel with the recipient major surface 83 of the mount 8, the distal end face 71 of the thermal head 7 coming in contact with the porous impression die member 1 is moved all over the impression surface 102 of the same to carve a desired character(s) and/or drawing derived from the heating element thermo control data and produce the impression die in the impression surface 102 of the porous impression die member 1.

The term 'contact' means that two objects are in the state of being close together, and in the context of this embodiment where the thermal head 7 is brought in contact with the impression surface 102 of the porous impression die member 1, the former may apply zero pressure or a certain level of pressure to the latter. Even if applying a certain level of pressure, the thermal head 7 is able to be close together with the porous impression die member 1 so far as the latter has sufficient hardness over the pressure. As discussed later, the porous impression die member 1 under pressure is never compressed (compressibility rate of 0%) or is only slightly compressed (compressibility rate of 1%). The compressibility rate is preferably in a range of 0 to 1%, and most desirably, 0%.

The thermal head 7 may be the one commercially available in the name of Real Edge Type Thermal Head (from Kyocera) that is supported like a stalk in a relative position to the mount 8 on its downstream side toward which the mount 8 is to be moved.

The area in which the impression die is made during carving the impression surface 102 of the porous impression die member 1 is totally determined by the mount 8 serving as a surface of reference, and hence, the die member adhered frame 21 fitted and fixed onto the mount 8 also serves as an indirect object of reference during carving the impression die in position. Thus, although the first step and the first means in and by which the porous impression die member 1 is hermetically adhered to the front end face 22 of the frame 2 may result in a slight deviation of the porous impression die member 1 from the predetermined position of adhesion, such failure in seal-carving as the impression die made in the impression surface 102 of the porous impression die member 1 is deviated from the area determined by the mount 8 (or indirectly, by the frame 2) serving as the surface of reference would no longer happen.

Referring to FIG. 5, now described in detail will be a fourth step and a fourth means of this embodiment in and by which after removing the die member adhered frame 21 from the mount 8, the porous impression die member 1 has its rear, ink impregnating face 100 brought in contact with the ink retainer 3 soaked with ink, so as to permit the holder 4 keeping the ink retainer 3 therein to hold the die member adhered frame 21.

The fourth step and the fourth means are a step and a means in and by which the porous stamp assembly 10 is finished by permitting the holder 4 to fit in and hold the die member adhered frame 21 where the impression die member 1 is carved into the impression die/stamping face in the previous or third step and means.

First, the ink retainer 3 soaked with ink is bonded to and retained in an inner surface of the side wall of the holder 4. After that, the holder 4 keeping the ink retainer 3 therein is fitted in the die member adhered frame 21 and holds the same to have the porous stamp assembly 10. At this time, the ink retainer 3 soaked with ink is put in contact with the rear, ink impregnating face 100 of the porous impression die member 1.

The holder 4 and the frame 2 are joined together by intermesh fitting, over-ride fitting, and/or the like. The female member 23 provided in the inner surface of the side wall of the frame 2 is securely fitted on the mating male member 41 provided in the outer surface of the side wall of the holder 4.

Although not shown in the drawing, another pair of the mating members, namely, the female member provided in the frame 2 is securely fitted on the male member provided in the holder 4 so as to ensure a relative orientation of the frame 2 with the holder 4.

Once the holder 4 to which the ink retainer 3 is securely bonded and the die member adhered frame 21 mate with each other, instantaneously the porous impression die member 1 begins to get impregnated with ink directly supplied from its rear, ink impregnating face 100. Thus, the porous impression die member 1 can be impregnated with ink more rapidly.

Again, since the area in which the impression die is made is determined by the mount 8 (or indirectly, by the frame 2) serving as the surface of reference, securely fitting the frame 2 on the holder 4 in position as desired can avoid a trouble that the impression die is deviated from the predetermined area.

Figure 6:
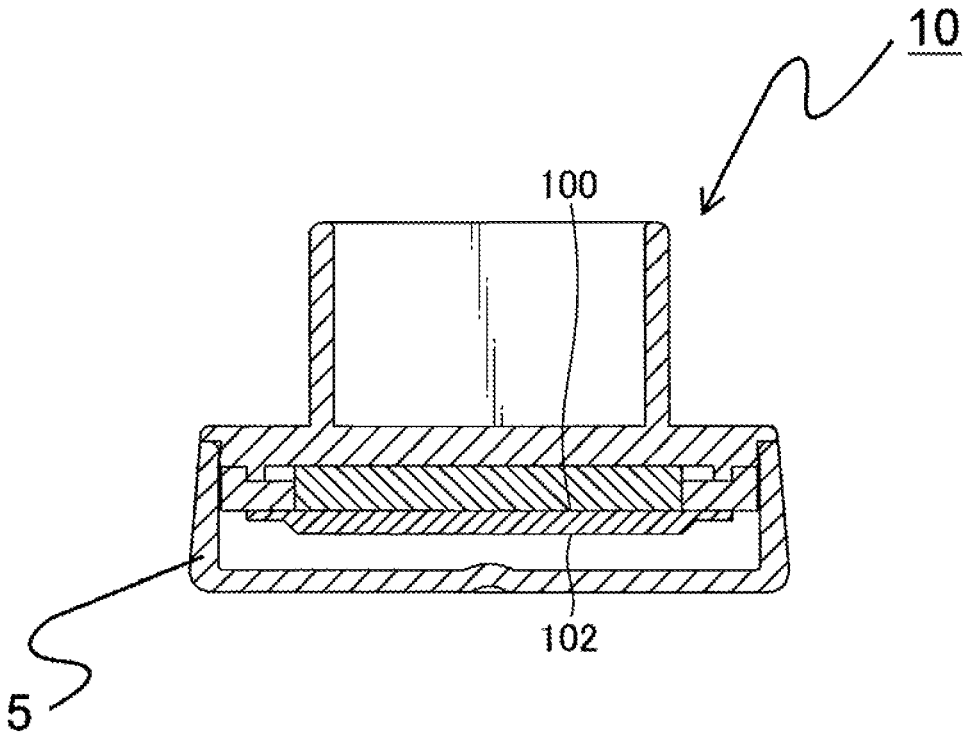
FIG. 6 depicts a porous stamp assembly with a cap attached thereto in the first embodiment.

Also, as shown in FIG. 6, a cap 5 may be attached to the holder 4 if necessary. With the cap 5, the impression die can be protected, as a matter of course, and besides, the porous impression die member can be impregnated with ink more quickly because the porous impression die member can have the impression die kept face-down in a vertical direction (the same as that of the gravitational force) while it is being supplied with ink.

Figure 7:
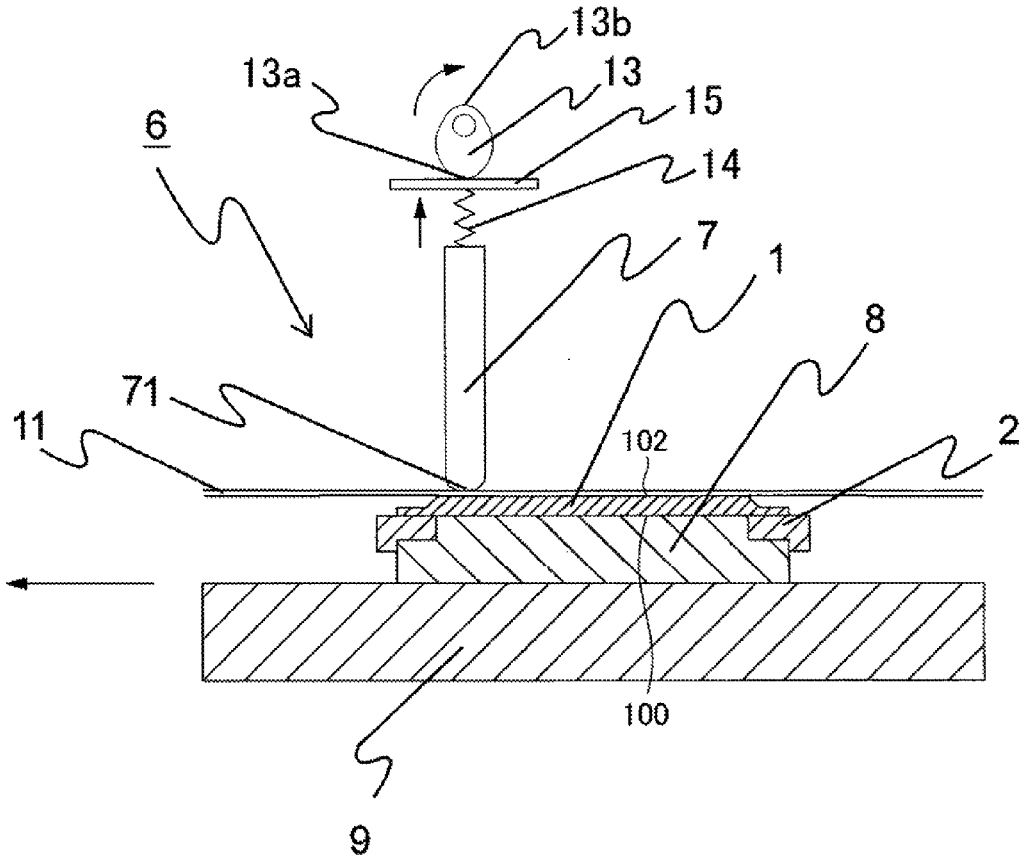
FIG. 7 is a diagram showing a third step and a third means in a second or third embodiment of the present invention.
Figure 8:
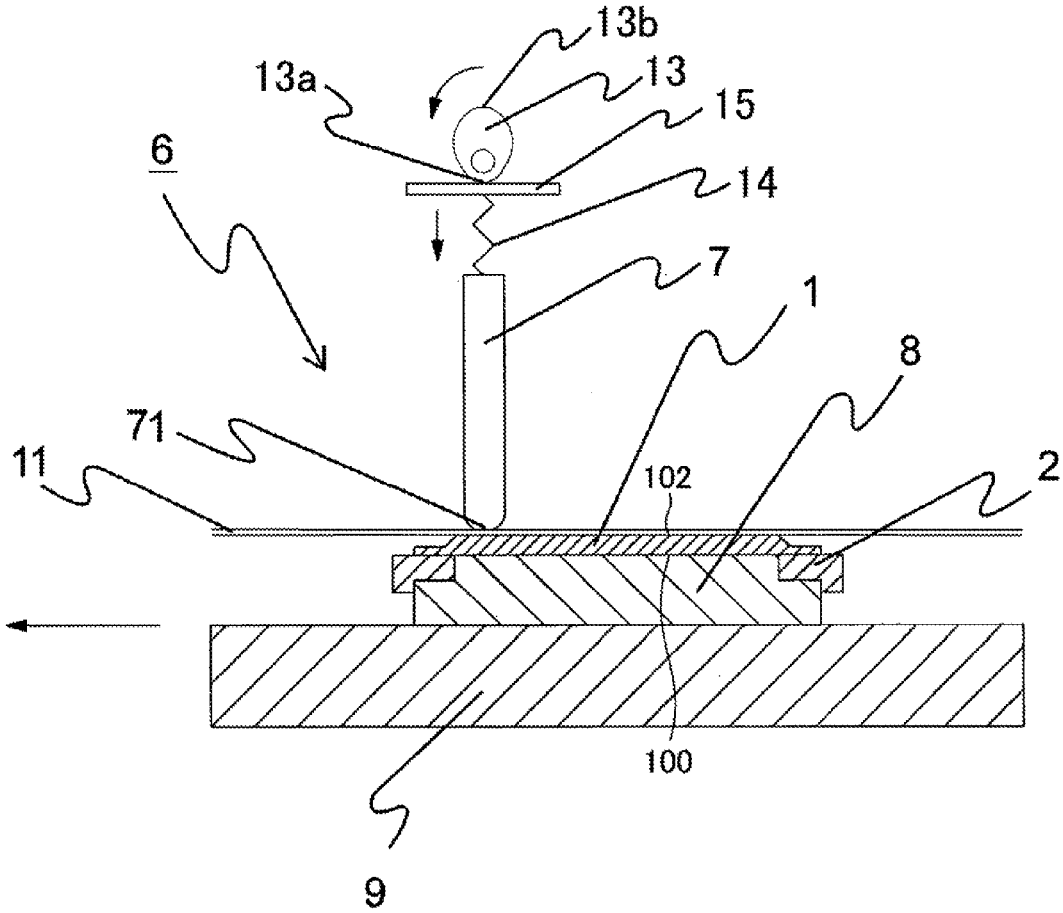
FIG. 8 is another diagram showing the third step and the third means in the second or third embodiment of the present invention.

The present invention will be further discussed in detail in the context of second and third embodiments, with reference to FIGS. 7 and 8, and especially, in conjunction with the third step in which when the thermal head 7 is put in contact with the impression surface 102 of the porous impression die member 1, with the resin film 11 interposed therebetween, the porous impression die member 1 has compressibility rate of 0 to 1%. Hereinafter, only differences from the previous embodiment will be discussed. The compressibility rate is preferably in a range of 0 to 1%, and most desirably, 0%.

The term 'compressibility rate' means the quotient expressed in percentage for an amount of compression of the porous impression die member 1 in contact with the thermal head 7 divided by a thickness of the porous impression die member 1. The thickness of the porous impression die member 1 used in this embodiment is 1.0 mm.

This embodiment can be put into practice on the assumption that pressure of the thermal head 7 against the impression surface 102 of the porous impression die member 1 (referred to as 'contact force' hereinafter) is 0.1 to 1.0 $N/mm^2$ (newton/square millimeter) while the porous impression die member 1 has durometer hardness of 50 to 60 (in conformity to US standard ASTM D2240 Type E Scale).

The thermal head 7 has a pressing mechanism to put the thermal head 7 in contact with the porous impression die member 1 together with the overlying resin film 11, and the pressing mechanism is provided with a load adjustment mechanism that is capable of adjusting the contact force of the thermal head 7 against the porous impression die member 1.

The pressing mechanism has an opposition cam 13 placed in relation with the thermal head 7, a compressible spring 14 placed between the cam 13 and the thermal head 7 for serving as a pushing element, and a cam contact plate 15 between the compressible spring 14 and the cam 13, and in this embodiment, the cam 13 and the cam contact plate 15 work together to serve as the load adjustment mechanism.

The cam 13 is capable of reciprocating/rotating within a predetermined angular range and has a top member 13*b* placed the closest to the rotation center, and a bottom member 13*a* coupled in a position opposite to the top member 13*b* and the farthest from the rotation center. The cam 13 in opposition to the cam contact plate 15 is rotated from a position of the bottom member 13*a* (FIG. 7) to another position of the top member 13*b* (FIG. 8) and vice versa, thereby adjusting the contact force of the thermal head 7 against the porous impression die member 1.

In this embodiment, the contact force is 0.1 to 1.0 N/mm$^2$ under control of the load adjustment mechanism.

The porous impression die member 1 preferably has durometer hardness of 50 to 60 (in conformity to US standard ASTM D2240 Type E Scale). Within the range of durometer hardness from 50 to 60, the impression die exhibits a moderate elasticity, which is prone to cause a blur and/or a smudge in the impressed seal. In this embodiment, measurement is made in the atmospheric conditions of 20° C. temperature and 65% humidity, using Asker Rubber Type E Durometer commercially available from Kobunshi Keiki Co., Ltd.

When it is less than 50 in durometer hardness, the porous impression die member 1 is more likely to have an excessive distortion as its porosity is increased, and the resultant impression die consumes more ink for single stamping and is more likely to produce a blur in the impressed seal. With the durometer hardness of 60 or even higher, the porous impression die member 1 has its porosity decreased and its elasticity lost, and the impressed seal is more likely to bear a smudge.

In this embodiment, when the contact force is 0.1 to 1.0 N/mm$^2$, and the durometer hardness ranges from 50 to 60, the porous impression die member 1 exhibits compressibility rate of 0 to 1%.

With the porous impression die member 1 of the durometer hardness ranging from 50 to 60 and when the contact force is less than 0.1 N/mm$^2$, only part of or a shoulder of the thermal head 7 comes in contact with the porous impression die member 1, or otherwise the thermal head 7 makes skipped sweep. When the contact force exceeds 1.0 N/mm$^2$, the thermal head 7 compresses the porous impression die member 1, and hence, the thermal head 7 is prone to hitch the porous impression die member, resulting in the impression die distorting.

For the varied contact force, the amount of compression and the compressibility rate of the porous impression die member 1 of the varied durometer hardness were measured, and the measurement results are shown in Table 1 below.

TABLE 1

Amount of Compression/Compressibility Rate of the Porous Impression Die Member for the Varied Contact Force of the Thermal Head, and the Resultant Surface Condition of the Impression Die n = 30

| | Contact Force (N/mm$^2$) | | | | | | | | |
|---|---|---|---|---|---|---|---|---|---|
| | 0.1 | 0.3 | 0.5 | 0.7 | 1.0 | 1.2 | 1.4 | 1.6 | 1.8 |
| **Durometer Hardness 50** | | | | | | | | | |
| Amount of Compression (mm) | 0.00 | 0.00 | 0.00 | 0.00 | 0.01 | 0.02 | 0.04 | 0.06 | 0.08 |
| Compressibility Rate (%) | 0 | 0 | 0 | 0 | 1 | 2 | 4 | 6 | 8 |
| Surface Condition of Die | Very Good | Very Good | Very Good | Very Good | Good | Furrowed | Furrowed | Furrowed | Furrowed |
| **Durometer Hardness 55** | | | | | | | | | |
| Amount of Compression (mm) | 0.00 | 0.00 | 0.00 | 0.00 | 0.00 | 0.01 | 0.02 | 0.04 | 0.06 |
| Compressibility Rate (%) | 0 | 0 | 0 | 0 | 0 | 1 | 2 | 4 | 6 |
| Surface Condition of Die | Very Good | Very Good | Very Good | Very Good | Very Good | Good | Furrowed | Furrowed | Furrowed |
| **Durometer Hardness 60** | | | | | | | | | |
| Amount of Compression (mm) | 0.00 | 0.00 | 0.00 | 0.00 | 0.00 | 0.00 | 0.01 | 0.02 | 0.04 |
| Compressibility Rate (%) | 0 | 0 | 0 | 0 | 0 | 0 | 1 | 2 | 4 |
| Surface Condition of Die | Very Good | Very Good | Very Good | Very Good | Very Good | Very Good | Good | Furrowed | Furrowed |

Each figure of the results given in Table 1 is a mean value of 30 measurements. The amount of compression of the porous impression die member 1 was measured by using a laser displacement gauge (LK-GD500 commercially available from Keyence).

From the measurement results given above, it will be recognized that for any of condition sets of hardness 50/contact force 0.1 to 1.0 N/mm$^2$, hardness 55/contact force 0.1 to 1.2 N/mm$^2$, and hardness 60/contact force 0.1 to 1.4 N/mm$^2$, the compressibility rate fell in the range of 0 to 1%, and the surface condition of the impression die was satisfactory. Thus, with the porous impression die member having durometer hardness of 50 to 60, the contact force producing 0 to 1% compressibility rate is required to range from 0.1 to 1.0 $N/mm^2$.

This means that the hardness of the porous impression die member 1 surpasses the pressure applied to the same by the thermal head 7, and hence, the porous impression die member 1 would never be compressed (zero compressibility rate) or could only slightly be (1% compressibility rate). Although an ideal range of the compressibility rate is from 0 to 1%, the compressibility rate of 0% at which the porous impression die member 1 is not compressed at all brings about the most optimized surface condition of the impression die and thus is the most desirable.

With reference to FIGS. 9 to 12, the present invention will now be described in the context of a fourth embodiment and especially in conjunction with the second step and the second means in and by which after the mount 8 is provided in position where the mount is to be in face-to-face relation with the thermal head 7 attached to the seal carving device 6, the die member adhered frame 21 has its side wall 24 fitted and fixed in space defined between a side surface of the mount 8 and a raised portion 85 by which the mount 8 is flanked, for bringing the recipient major surface of the mount 8 in contact with the rear, ink impregnating face 100 of the porous impression die member 1. Hereinafter, only differences from the previous embodiments will be discussed.

Figure 12:
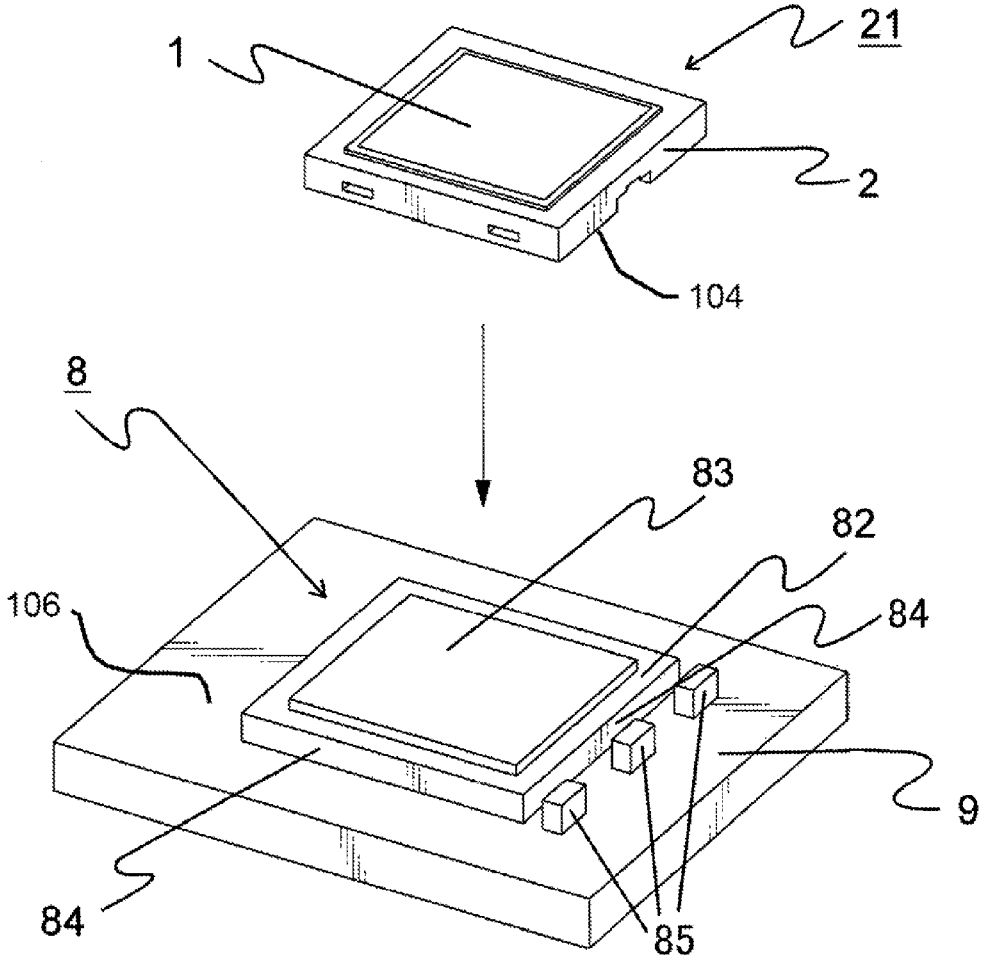
FIG. 12 is a perspective view illustrating the second step and the second means in an alternative to the fourth embodiment of the present invention.

The raised portion 85 is provided alongside of the side surface 84 of the flange 82 and spaced from the same by a thickness of the side wall 24 of the frame 2. Although the raised portion 85 may partially or fully surround the frame 2 along its perimeter, it is essential to position it on a side toward which the relative movement of the thermal head 7 to the mount 8 causes a load to press down (i.e., on the right in FIG. 11). The raised portion 85 may be appropriately varied in shape, number, volume, and the like; for instance, as shown in FIG. 10, it may be a single rectangular parallelepiped that has the same length as the side surface 84 of the flange 82, or rather, as shown in FIG. 12, three of small pieces, namely, one in the middle and the remaining two on both sides, may be provided in a well-balanced arrangement, so as to permit a user to remove the die member adhered frame 21 from the mount 8 with his or her minimum effort.

Figure 9:
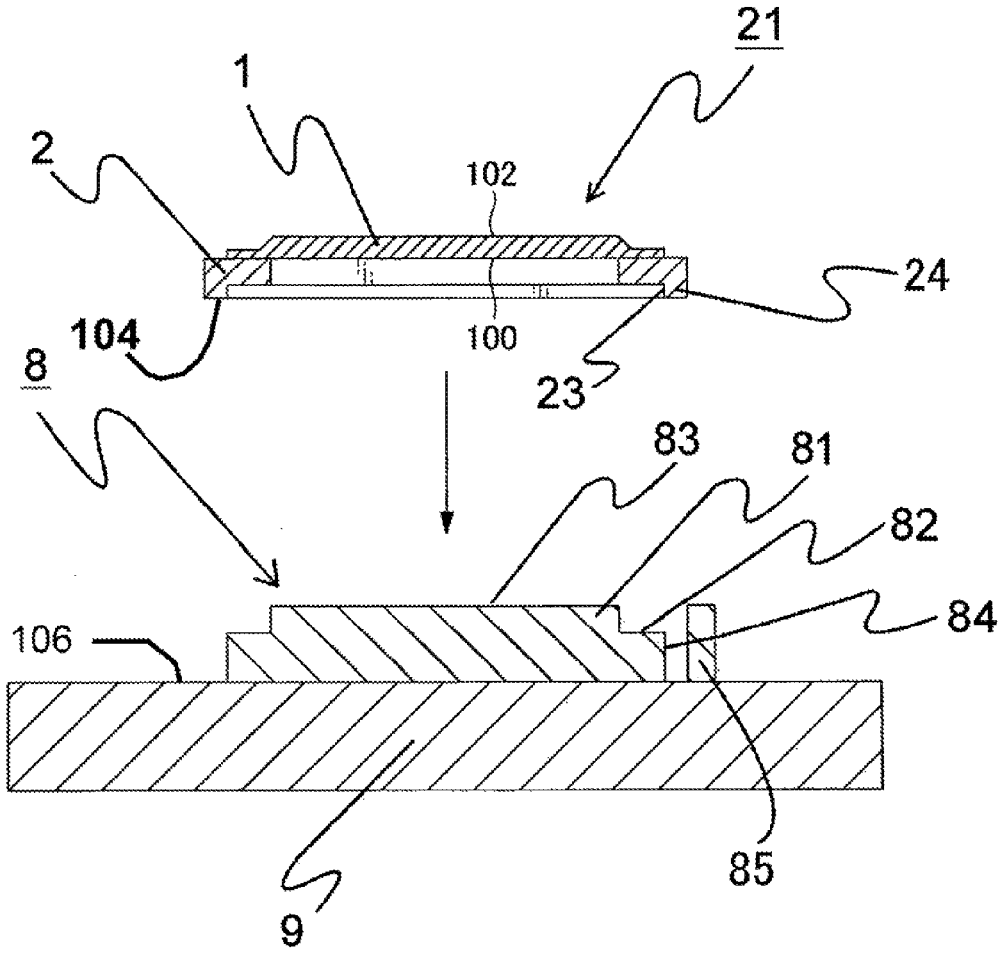
FIG. 9 is a diagram showing a second step and a second means in a fourth embodiment of the present invention.
Figure 10:
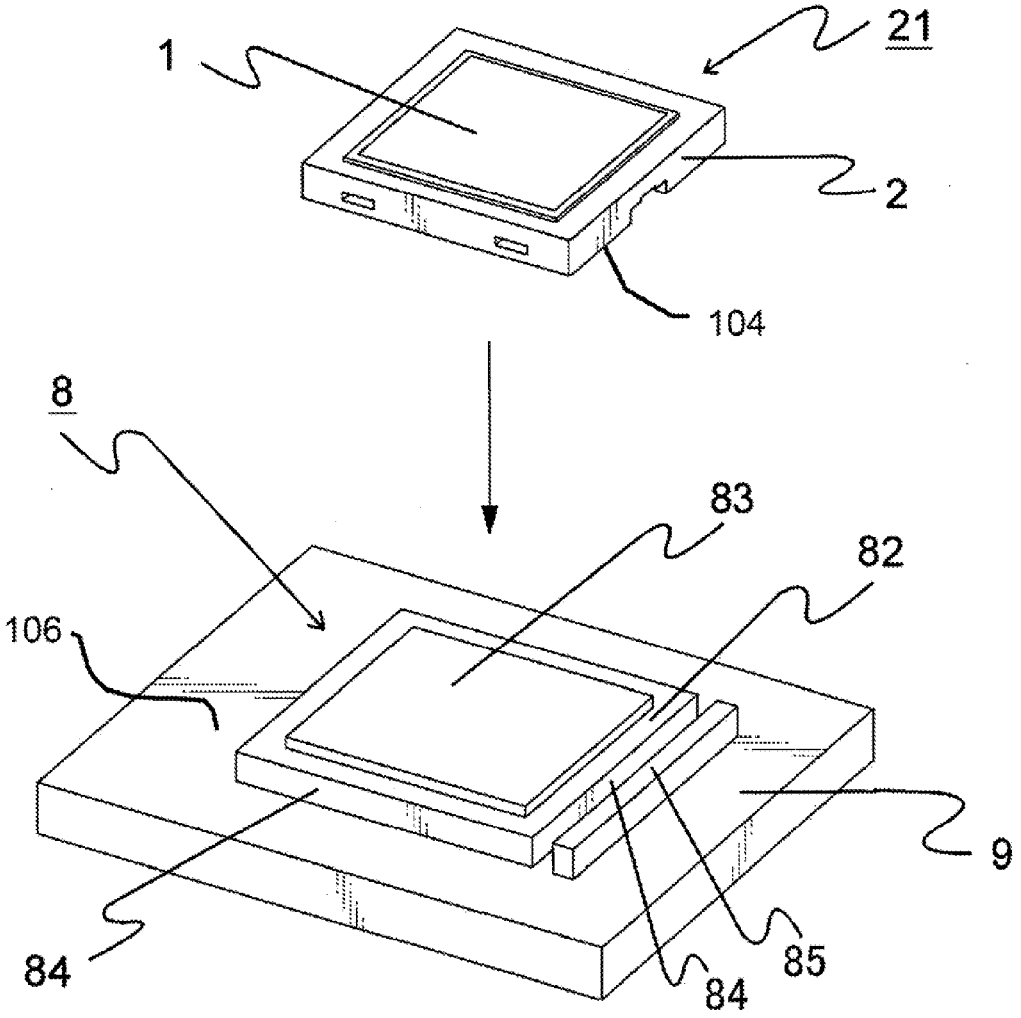
FIG. 10 is a perspective view illustrating the second step and the second means in the fourth embodiment of the present invention.
Figure 11:
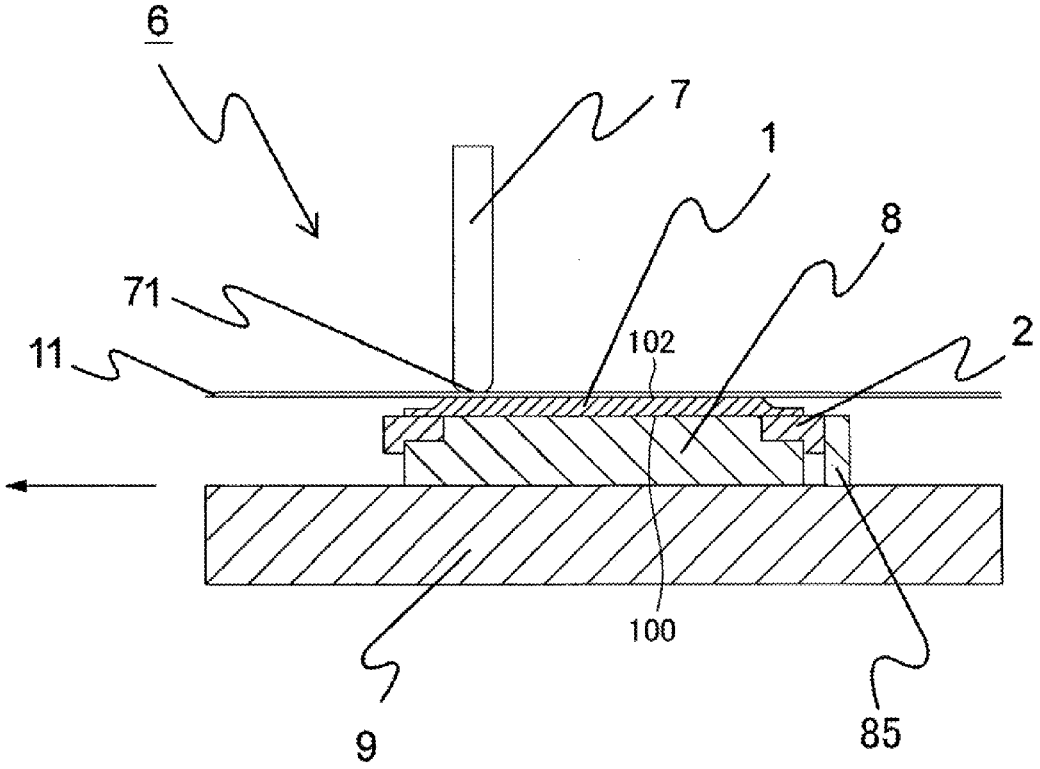
FIG. 11 is a diagram showing a third step and a third means in the fourth embodiment of the present invention.

As shown in FIGS. 9 and 10, the die member adhered frame 21 is attached to the mount 8, putting its reverse end face 104 in contact with the recipient major surface 83 of the mount 8. At that time, the inner surface of the side wall of the frame 2 is fitted on the side surface 84 of the flange 82 while the outer surface of the side wall of the frame 2 is fitted on the raised portion 85, and thus, the side wall 24 of the frame 2 is securely fitted in space defined between the side surface 84 of the flange 82 and the raised portion 85. Concurrently, the rear, ink impregnating face 100 of the porous impression die member 1 comes in contact with the recipient major surface 83 of the mount.

As will be recognized, the frame 2 has its side wall 24 fitted and fixed between two steady elements because the side wall 24 of the frame 2 should avoid deformation during seal-carving in the third step and by the third means. During seal-carving in the third step and by the third means, the thermal head 7 and the porous impression die member 1 kept in contact with each other are moved relative to each other, and hence, it is more likely to happen that the relative movement of the thermal head 7 causes the frame having the porous impression die member 1 bonded thereto to deform, resulting in deviation of the impression die. Such deviation is more likely as the frame 2 has a reduced thickness. A solution to this trouble is the improved version of the frame 2 that can have its side wall fitted and fixed between two steady elements.

Figure 13:
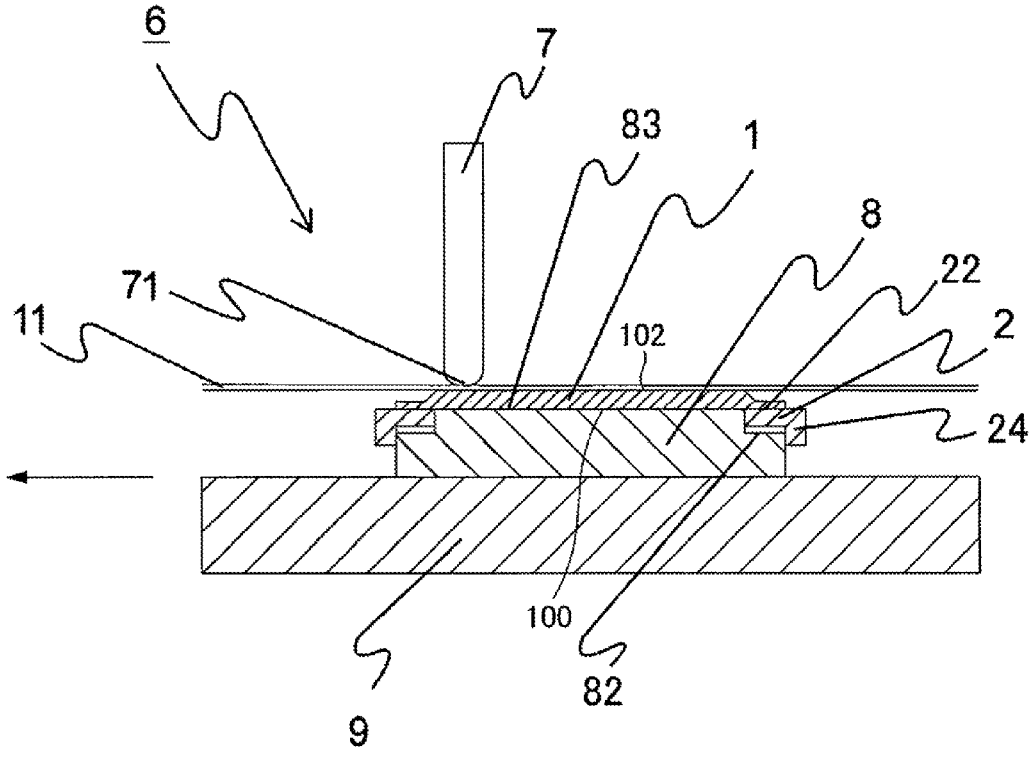
FIG. 13 is a diagram showing a third step and a third means in a fifth embodiment of the present invention.
Figure 14:
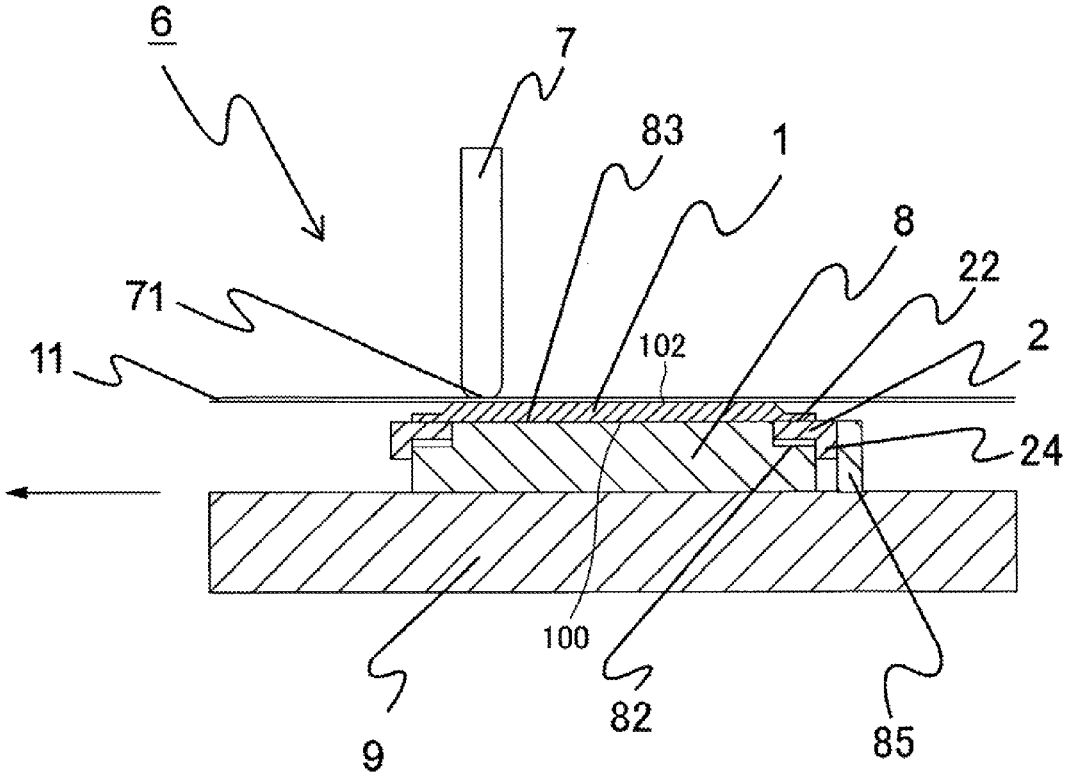
FIG. 14 is a diagram showing the third step and the third means in an alternative to the fifth embodiment of the present invention.

Referring to FIGS. 13 and 14, the present invention will be further described in detail in the context of a fifth embodiment and especially in conjunction with the second step and the second means in and by which the die member adhered frame 21 has its reverse end face 104 kept out of contact with the recipient major surface of the mount holder 9 that keeps the mount 8 thereon. Hereinafter, only differences from the previous embodiments will be discussed.

As shown in FIGS. 13 and 14, dimensional adjustment in advance should be scrupulous so as to keep the reverse end face 104 of the die member adhered frame 21 out of contact with the recipient major surface of the mount holder 9 keeping the mount 8 thereon. The term 'reverse end face' of the die member adhered frame 21 means a lower end face of the side wall 24 and the reverse side to the front end face 22 of the frame 2. Also, the term 'recipient major surface' of the mount 8 primarily means a receiving face of the flange 82.

In order to keep the lower end face of the side wall 24 out of contact with the recipient major surface 106 of the mount holder 9, several ways are contemplated, including cutting the side wall 24 short, scraping the surface of the mount holder 9 away, and a combination of them. Also, in order to keep the reverse side to the front end face 22 of the frame 2 out of contact with the flange 82, several ways are contemplated, including getting the frame 2 thinner, scraping the surface of the flange 82 away, and a combination of them.

Thus, in this embodiment, the recipient major surface 83 of the mount 8 and the rear, ink impregnating face 100 of the porous impression die member 1 alone are in contact with each other. Hence, even if some dimensional error in molding makes the side wall 24 of the die member adhered frame 21 slightly longer, or if it makes the frame 21 itself thicker, it is advantageously avoidable that the recipient major surface of the mount 8 keeps out of contact with the rear, ink impregnating face 100 of the porous impression die member, letting the latter float up.

Unless it floats up, the porous impression die member 1 is furrowless during seal-carving and capable of reproducing a desired character(s) and/or drawing in the impression die with high precision, and restrictions on molding are eased since extreme dimensional accuracy is not required.

Figure 15:
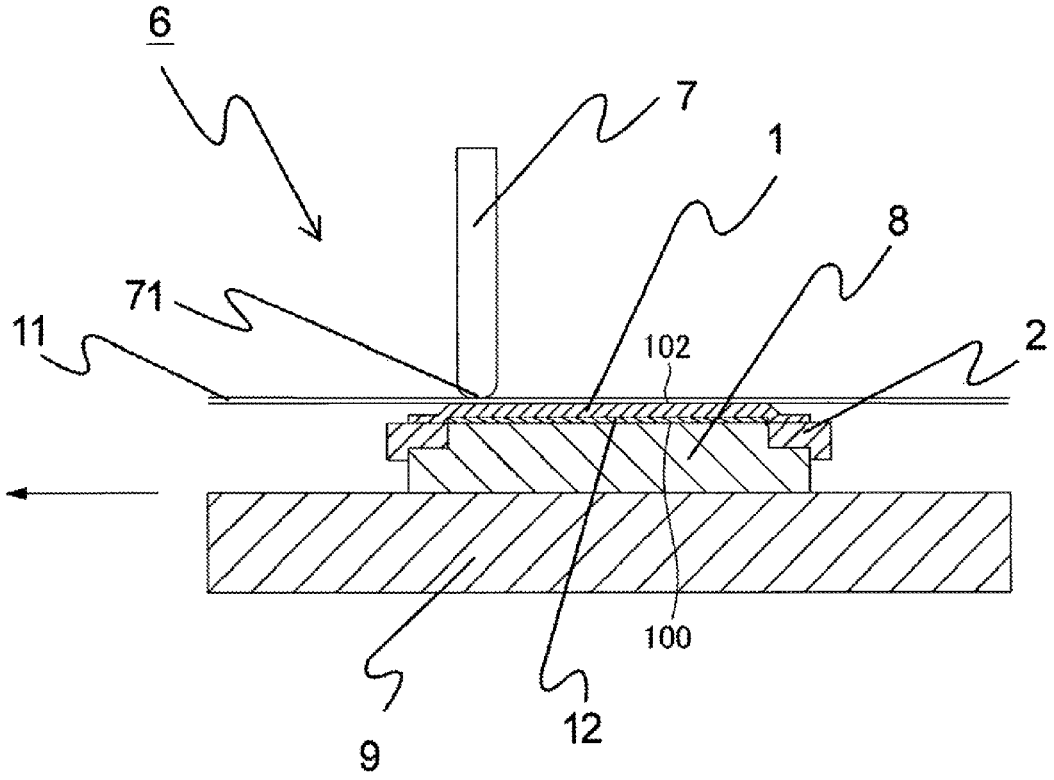
FIG. 15 is a diagram showing a third step and a third means in a sixth embodiment of the present invention.

Referring to FIG. 15, the present invention will now be described in detail in the context of a sixth embodiment and especially in conjunction with the second step and the second means in and by which the friction auxiliary element is provided on the recipient major surface of the mount 8. Hereinafter, only differences from the previous embodiments will be discussed.

In the third step and by the third means, the thermal head 7 and the porous impression die member 1 come in contact with each other and are moved relative to each other, and hence, the impression surface 102 of the porous impression die member 1 partially fused by the thermal head 7 is likely to be hitched, resulting in the impression die carved therein being deviated from the position it is to be in. To cope with this, a friction auxiliary element 12 may be provided to strengthen the retainability of contact between the recipient major surface 83 of the mount 8 and the rear, ink impregnating face 100 of the porous impression die member 1. The friction auxiliary element 12 may be anything that have gone through chemical treatment such as applying minimal adhesiveness and/or physical treatment such as applying adhesiveness, projections, and the like.

As to the chemical treatment such as applying minimal adhesiveness, any of appropriate natural and synthetic adhesion agents may be used for the porous impression die member 1 that should be peelable.

As to the physical treatment, any of appropriate viscous thermoplastic resins and viscous thermoplastic elastomers may be used, and it is also possible that needle-like projections are provided on the recipient major surface 83 of the mount 8 to enhance frictional force unless it gives an adverse effect on seal-carving.

In this way, with the friction auxiliary element 12 provided on the recipient major surface 83 of the mount 8, it is avoidable that the porous impression die member 1 having its part fused by the thermal head is hitched by the thermal head in the course of the relative movement to cause a deviation of the impression die carved therein, and hence, a desired character(s) and drawing can be reproduced in the impression die with high precision. This is more effective as an area in which impression die is made is increased.

Next, a second embodiment of the porous stamp assembly according to the present invention will be described in detail on condition that the porous impression die member 1 has thickness ranging from 0.1 to 1.2 mm.

The porous impression die member may be in the form of a thin membrane material such as a sheet ("sheet-form"), a film ("film-form"), or the like, and may be preferably 0.1 to 1.2 mm in thickness for the purpose of shortening time required for ink impregnation.

In order to enhance molding efficiency, the porous impression die member is preferably 0.8 to 1.2 mm in thickness. The porous impression die member having thickness from 0.8 to 1.2 mm can be molded by an extruder, and for molding a sheet member thinner than 0.8 mm, a heat pressing machine must be used although the molding efficiency is slightly reduced.

Using samples of the porous impression die member having a variety of thicknesses ranging from 1.0 to 2.0 mm, a comparison test on ink impregnation time was carried out.

The comparison test contained Examination 1 and Examination 2, and prepared were the samples of the porous impression die member that have the same longitudinal and lateral dimensions of 13.0 mm×42.0 mm and have mutually different thicknesses of 0.1 mm, 0.8 mm, 1.0 mm, 1.2 mm, 1.5 mm, and 2.0 mm. Ink employed was a fat dye black ink having viscosity of 300 mPa·s (Dye Ink XR-2N (X-200) Black available from Shachihata Inc.), and the test was conducted in the atmospheric conditions of 20° C. temperature and 65% humidity.

In Examination 1, the porous impression die member was dipped in 10 g of the ink filling a petri dish, and thereafter, time required to impregnate the entire porous impression die member with the ink was measured.

In Examination 2, the ink retainer employed was a polyolefin fiber pad that had longitudinal, lateral, and thicknesswise dimensions of 13.0 mm×42.0 mm×3.0 mm and weight of 0.5 g, and was impregnated with 1.5 g of the ink in advance. After the frame with the porous impression die member hermetically adhered thereto was fitted and fixed onto the holder keeping the ink impregnated retainer therein, time required to impregnate the entire porous impression die member with ink was measured. This was a measurement test for the ink impregnation time in the fourth step.

The results of Examination 1 and Examination 2 will be provided in Table 2 as follows:

TABLE 2

Test Results on Ink Impregnation Time n = 30

| | Thickness | | | | | |
|---|---|---|---|---|---|---|
| | 0.1 mm | 0.8 mm | 1.0 mm | 1.2 mm | 1.5 mm | 2.0 mm |
| Examination 1 | 5 sec. | 20 sec. | 30 sec. | 60 sec. | 150 sec. | 350 sec. |
| Examination 2 | 15 sec. | 130 sec. | 180 sec. | 300 sec. | 420 sec. | 750 sec. |

Each of figures of the results in Table 2 is a mean value of 30 measurements. From the above test results, it will be appreciated that the porous impression die member having thickness from 0.1 to 1.2 mm completed ink impregnation in 60 seconds (1 minute) in Examination and in 300 seconds (5 minutes) in Examination 2. This sample of the porous impression die member shows a considerably better effect in comparison with another sample having thickness from 1.5 to 2.0 mm.

Figure 16:
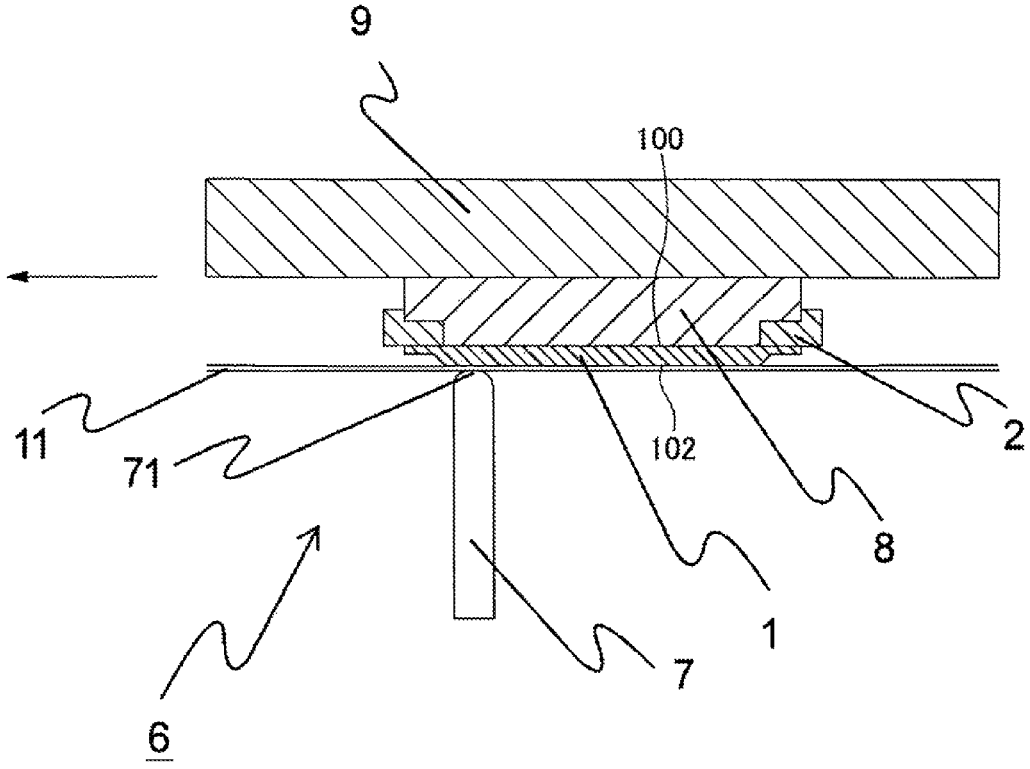
FIG. 16 is a diagram showing the third step and the third means in an alternative to the first embodiment of the present invention.
Figure 17:
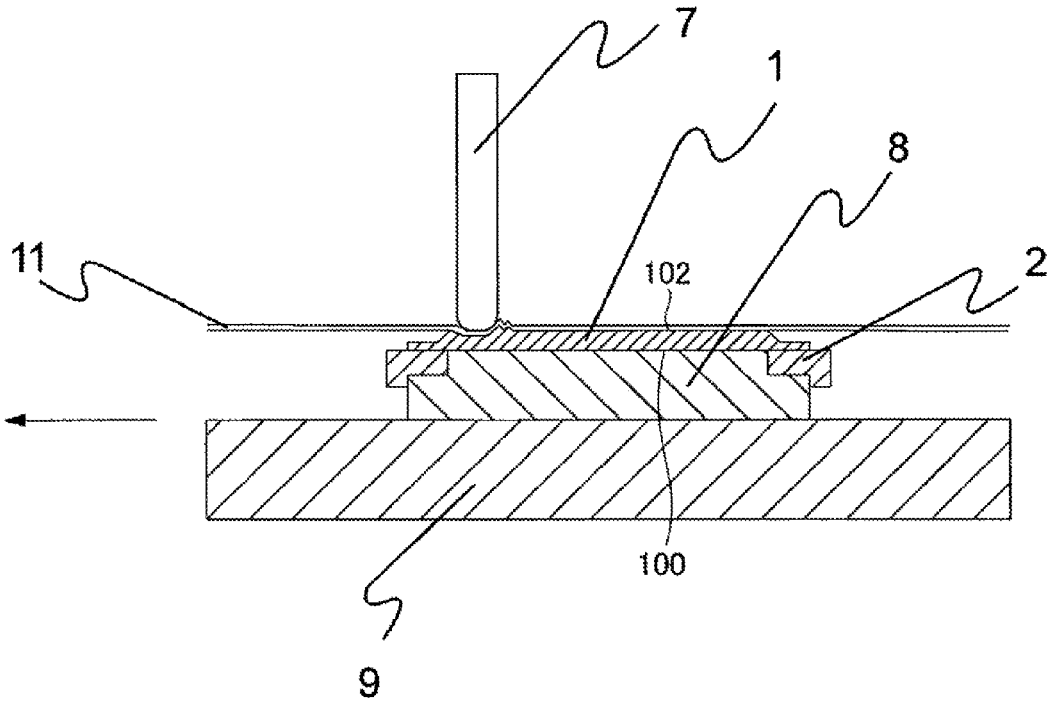
FIG. 17 is a schematic view illustrating a porous impression die member being compressed while an impression die is carved therein.

Although the embodiments in which the thermal head 7 is set in an upper position relative to the mount 8 have been described so far, the mount may be set in the upper position relative to the thermal head, as illustrated in FIG. 16. All the first to seventh embodiments are modifiable in this manner.

Although the present invention has been described in terms of the most practical and preferable embodiments at present, the invention is not to be limited to the precise forms as disclosed in this specification, and instead, it is intended that the invention should be appropriately modifiable without departing from the true gist or spirit of the invention taught or suggested in the appended claims and the specification in combination and that the porous stamp assembly, and the method and apparatus of manufacturing the same modified in such a manner should fall in the technical scope of the invention.

The invention claimed is:

1. A manufacturing method of a porous stamp assembly, comprising the steps of hermetically adhering a thin porous impression die member of thermoplastic resin to a front end face of a frame, for preparing a die member adhered frame, wherein the thin porous impression die member has a rear, ink impregnating face and a front, impression surface, fixing the die member adhered frame onto a mount having a recipient major surface that is to be in face-to-face relation with a thermal head attached to a seal carving device, with the recipient major surface of the mount in contact with the rear, ink impregnating face of the thin porous impression die member, wherein the recipient major surface of the mount is planar and of sufficient hardness to protect the mount from deformation when the thin porous impression die member comes into contact with the thermal head, carving the impression surface of the thin porous impression die member into an impression die without deforming the mount at the recipient major surface thereof, by putting the thermal head in contact with the impression surface of the thin porous impression die member, with a resin film interposed therebetween, and moving the thermal head and the thin porous impression die member relative to each other in a direction parallel to the plane of the recipient major surface of the mount, removing the die member adhered frame from the mount after the carving step, and after step of removing the die member adhered frame from the mount, fitting the die member adhered frame in a holder holding an ink retainer soaked with ink, with the rear, ink impregnating face of the thin porous impression die member in contact with the ink retainer soaked with ink, to impregnate the carved thin porous impression die member with ink.

2. The manufacturing method according to claim 1, wherein the step of putting the thermal head in contact with an impression surface of the thin porous impression die member includes using the thermal head to compress the thin porous impression die member by a contact force of 0.1 to 1.0 $N/mm^2$, and wherein the thin porous impression die member has a durometer hardness range of 50 to 60.

3. The manufacturing method according to claim 1, wherein the step of putting the thermal head in contact with an impression surface of the thin porous impression die member includes using the thermal head to compress the thin porous impression die member by a contact force of 0.1 to 1.0 $N/mm^2$, and wherein the thin porous impression die member has a durometer hardness of 50.

4. The manufacturing method according to claim 1, wherein the step of fixing the die member adhered frame includes fitting and fixing a side wall of the die member adhered frame in space defined between a side surface(s) of the mount and a raised portion(s) by which the mount is partially or fully surrounded.

5. The manufacturing method according to claim 1, wherein the step of fixing the die member adhered frame includes keeping a reverse end face of the die member adhered frame out of contact with the recipient major surface of the mount and an upper major surface of a mount holder keeping the mount thereon.

6. The manufacturing method according to claim 1, wherein the step of fixing the die member adhered frame includes providing a friction auxiliary element on the recipient major surface of the mount.

7. The manufacturing method according to claim 1, wherein the thin porous impression die member has a thickness of between 0.1 mm to 1.2 mm.

8. The manufacturing method according to claim 7, wherein the thin porous impression die member has a thickness of between 0.8 and 1.2 mm.

9. A manufacturing apparatus of a porous stamp assembly, comprising:

means for preparing a die member adhered frame by hermetically adhering a thin porous impression die member of thermoplastic resin to a front end face of a frame, the thin porous impression die member having a rear, ink impregnating face and an impression surface, a mount configured for placement of the die member adhered frame during carving of the impression surface of the thin porous impression die member, the mount having a front surface and a recipient major surface, against which the entire rear, ink impregnating face of the thin porous impression die member is brought into contact, wherein the recipient major surface is dimensioned to fully contact the rear, ink impregnating face of the thin porous impression die member when the die member adhered frame is placed on the mount, a thermal head relatively movable with an aggregate of a resin film, the front surface of the mount, and the thin porous impression die member sandwiched therebetween in a direction parallel to the plane of the recipient major surface of the mount, to carve the impression surface of the thin porous impression die member into an impression die through the resin film without substantial compression of the thin porous impression die member, and a friction auxiliary element provided on the recipient major surface of the mount to strengthen contact between the recipient major surface of the mount and the ink impregnating face of the porous impression die member during relative movement of the thermal head, and means for removably retaining the die member adhered frame on the mount.

* * * * *